US005382959A

United States Patent [19]

Pett et al.

[11] Patent Number: 5,382,959

[45] Date of Patent: Jan. 17, 1995

[54] BROADBAND CIRCULAR POLARIZATION ANTENNA

[75] Inventors: Todd A. Pett, Longmont; Steven C. Olson, Broomfield; Ajay I. Sreenivas, Longmont, all of Colo.

[73] Assignee: Ball Corporation, Muncie, Ind.

[21] Appl. No.: 866,868

[22] Filed: Apr. 10, 1992

Related U.S. Application Data

[63] Continuation-in-part of Ser. No. 681,100, Apr. 5, 1991, Pat. No. 5,231,406.

[51] Int. Cl.[6] ..... H01Q 1/38

[52] U.S. Cl. ..... 343/700 MS; 343/846

[58] Field of Search ..... 343/700 MS, 829, 833, 343/834, 835, 846, 848, 847, 853; H01Q 1/38

[56] References Cited

U.S. PATENT DOCUMENTS

| | | | |
|---|---|---|---|
| 4,366,484 | 12/1982 | Weiss et al. | 343/700 MS |
| 4,623,893 | 11/1986 | Sabban | 343/700 MS |
| 4,651,159 | 3/1987 | Ness | 343/700 |
| 4,719,470 | 1/1988 | Munson | 343/700 MS |
| 4,761,654 | 8/1988 | Zaghloul | 343/700 MS |
| 4,835,538 | 5/1989 | McKenna et al. | 343/700 MS |
| 4,943,809 | 7/1990 | Zaghloul | 343/700 MS |
| 4,980,694 | 12/1990 | Hines | 343/700 MS |
| 5,041,838 | 8/1991 | Liimatainen et al. | 343/700 MS |
| 5,124,733 | 6/1992 | Haneishi | 343/700 MS |

OTHER PUBLICATIONS

Lee et al., "Microstrip Subarray with Coplanar and Stacked Parasitic Elements", Electronics Letters, May 10, 1990, vol. 26, No. 10, pp. 668–669.

*Primary Examiner*—Donald Hajec
*Assistant Examiner*—Hoanganh Le
*Attorney, Agent, or Firm*—Gilbert E. Alberding

[57] ABSTRACT

An efficient, lightweight, broadband antenna, having high quality circular polarization capabilities, is disclosed for use in a variety of applications. In one embodiment, signals are fed to, or received by, an array of electromagnetically coupled patch pairs arranged in sequential rotation by an interconnect network which is coplanar with the coupling patches of the patch pairs. The interconnect network includes phase transmission line means, the lengths of which are preselected to provide the desired phase shifting among the coupling patches. The complexity of the array and the space required are thus reduced. In one described embodiment, two such arrays are employed, each having four patch pairs. The two arrays are arranged in sequential rotation to provide normalization of the circularly polarized transmitted or received beam. In another embodiment, a lightweight material having a dielectric constant less than about 1.5 is employed in the lower resonant cavity and, preferably, in the upper resonant cavity as well.

5 Claims, 7 Drawing Sheets

BROADBAND CIRCULAR POLARIZATION ANTENNA

RELATED APPLICATION

This application is a continuation-in-part application of co-pending and commonly assigned U.S. Patent application Ser. No. 07/681,100 filed Apr. 5, 1991 and entitled "BROADBAND CIRCULAR POLARIZATION SATELLITE ANTENNA" by Sreenivas, now U.S. Pat. No. 5,231,406, which is hereby incorporated by reference.

TECHNICAL FIELD OF THE INVENTION

This invention relates in general to a broadband circular polarization antenna and, in particular, to an antenna arrangement of microstrip patches having high purity circular polarization, high efficiency and low weight.

BACKGROUND OF THE INVENTION

Microstrip patch antennas are popular because they are generally small and light, relatively easy to fabricate, and with the proper feeding/receiving network, can transmit/receive beams of various polarizations. The small size and light weight of microstrip patch antennas are particularly advantageous for satellite applications, in which such parameters directly affect project costs (such as the cost to launch a satellite into orbit), as well as for land-mobile and certain fixed-base applications.

Patch antennas which transmit and/or receive signals which are circularly polarized, as opposed to linearly polarized, are particularly useful in satellite communication systems. Linear polarization requires that an earth station tightly align its frame of reference with that of a satellite in order to achieve acceptable communications. Furthermore, as linearly polarized radiation propagates through the earth's atmosphere, its orientation tends to change, thus making the earth-satellite alignment difficult to maintain. Circularly polarized radiation is less affected by such considerations. However, to achieve satisfactory communications, the degree of circular polarization (as measured by axial ratio) should be relatively high over a relatively broad bandwidth.

The bandwidth of a directly fed microstrip patch antenna is generally narrow (compared to, for example, a standard horn antenna), due at least in part to the thinness of the substrate on which the patch is fabricated. To broaden bandwidth, electromagnetically coupled patches (EMCP) can be employed which include, for example, a coupling radiator patch on a first substrate and a parasitic antenna patch on a second substrate, the two patches being substantially parallel and separated by a particular distance. The greater the separation distance, the greater the increase in bandwidth. Bandwidth is further increased by selecting a material to fill the separation distance which has a low relative permittivity or dielectric constant (i.e., ideally one, the dielectric constant of air). Such material should preferably provide structural rigidity to insure uniform EMCP spacing, and should be lightweight.

One method to enhance the purity of circular polarization of patch antennas (i.e., to reduce the axial ratio) is to connect a plurality of complimentary patches to a feeding network in sequential rotation whereby there is a uniform angular spacing of the feeding points between the patches. In this fashion, the orientation of the radiation from each patch is rotated relative to the orientation of the radiation from complementary patches. Furthermore, the feeding network should preferably provide a uniform phase difference between the signals sent to or received from the patches. For example, in a four patch arrangement, the signal fed to the first patch has a particular phase relationship with respect to the feedline; the signal fed to the second patch lags by 90° the signal fed to the first patch; the signal fed to the third patch lags by 180° the signal fed to the first patch and lags by 90° the signal fed to the second patch; and the signal to the fourth patch lags by 270° the signal fed to the first patch, lags by 180° the signal fed to the second patch, and lags by 90° the signal fed to the third patch. In addition, the location of the feeding point on each patch is correspondingly rotated 90° so that the feed point of the second patch is rotated 90° with respect to the feed point of the first patch; the feed point of the third patch is rotated 90° with respect to the feed point of the second patch and 180° from the feed point of the first patch; and, the feed point of the fourth patch is rotated 90° with respect to the feed point of the third patch, 180° from the feed point of the second patch and 270° from the feed point of the first patch.

A larger number of feed patches can be used as long as the signal phases and feed locations are uniformly distributed around 360°. Ideally, the combined radiation from all of the patches would have perfectly circular polarization (i.e., OdB axial ratio). In actual practice, of course, such perfect circular polarization has not been achieved.

Heretofore, hybrids have often been employed to phase shift the signal fed to (or from) the patches in a sequential rotation network. The use of such hybrids in a feeding network may consume so much space, however, that in many applications with space constraints the feeding network may have to be situated on a separate substrate and coupled directly or electromagnetically to the microstrip patch (which can be an antenna patch or, in the case of EMCP, a coupling patch). As can be appreciated, this increases the complexity and cost of the antenna and tends to reduce its efficiency. If fewer patches are used, or if the same number of patches are used but they are spread out over a larger area, space may be available for the hybrids but the radiation pattern may have excessive grating lobes resulting in reduced efficiency and degraded coverage characteristics. If more patches are used, or if the same number of patches are used but are placed closer together, coupling between patches may seriously degrade antenna performance.

It is desirable, therefore, to provide an antenna having high purity circular polarization (i.e., a low axial ratio), substantially uniform coverage, broad bandwidth and high efficiency, and which is easy and inexpensive to fabricate. It is further desirable for such an antenna to be small, lightweight and to be capable of fabrication from space qualified materials so as to be well-suited for use in a satellite. It is also desirable that the material used between substrates in an EMCP pair have a low dielectric constant, be lightweight and rigid, and provide for substantially uniform spacing between the substrates.

SUMMARY OF THE INVENTION

In accordance with the present invention, a broadband antenna is provided having high purity circular polarization, substantially uniform coverage and high efficiency while being easy to fabricate. In addition, the antenna of the present invention is lightweight, small and can be fabricated with space qualified materials.

In particular, one embodiment of the antenna of the present invention employs an array of microstrip patches which are coupled in sequential rotation by phase transmission line means to a signal transmission means. The phase transmission line means comprise microstrip transmission lines whose lengths are preselected to provide appropriate phase shifting for the sequentially rotated patches. Therefore, space can be saved and the phase transmission line means can be coplanar with the patches. Preferably, portions of two or more phase transmission line means are defined by a common length of transmission line, wherein further space is saved.

In another aspect of the present invention, two or more subarrays are provided, wherein the patches of each subarray are coupled in sequential rotation. Preferably, the subarrays are also coupled in sequential rotation; i.e., the phase of the signal fed to or from each subarray is shifted relative to the phases of the other signals to provide substantially uniform phase shifting among the subarrays around 360° and the angular orientation of each subarray is shifted or clocked relative to that of the other subarray(s) to provide a substantially uniform rotation among the subarrays around 360°. Such an arrangement provides for normalization of the circularly polarized radiated signal (or, because the antenna is bi-directional, the received signal) providing a low axial ratio over a broad bandwidth.

For example, two subarrays can be provided, each having four electromagnetically coupled patch (EMCP) pairs of coupling (driven) and antenna (parasitic) radiator patch elements. The signal fed to the second subarray is phase shifted 180° from the signal fed to the first subarray and the second subarray is rotated 180° with respect to the first subarray. Sequential rotation among the four patch pairs in each subarray provides a 90° phase shift between adjacent patch pairs. The feed locations of the coupling patches are similarly shifted or clocked 90° within each subarray. When coupled to external circuitry to provide phase shifting of the signals fed to (or from) the antenna system, the antenna can scan a broad volume. Such an arrangement provides satisfactory performance for use in a satellite with substantially uniform coverage while reducing the space required for the antenna.

In one embodiment of the present invention, a lightweight, rigid honeycomb material is employed between the driven coupling patches and the parasitic antenna patches. In another embodiment, a lightweight, expanded foam material is employed. Such materials can also be employed between the coupling patches and a ground reference spaced below the coupling patch. The honeycomb material, the expanded foam material and other like materials should have a low dielectric constant (preferably approaching one) and be sufficiently rigid to yield substantially uniform spacing between the subarray layers.

Consequently, the antenna of the present invention provides the technical advantage of having a low axial ratio and a broad bandwidth, and being highly efficient with substantially uniform coverage and easy to fabricate. It provides the further technical advantages of being lightweight, small and capable of being fabricated with space qualified materials.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The present invention will be further described with reference to FIGS. 1–7. When used herein, such terms as "horizontal", "vertical", "top", "bottom", "upper", "lower", "left" and "right" are for descriptive purposes only and are not intended to limit the invention to any particular physical orientation. Furthermore, the antenna of the present invention is reciprocal in that it can receive signals, as well as transmit them. Consequently, references herein to "transmitting," "radiating" and "generating" beams apply equally to receiving beams.

Figure 1:
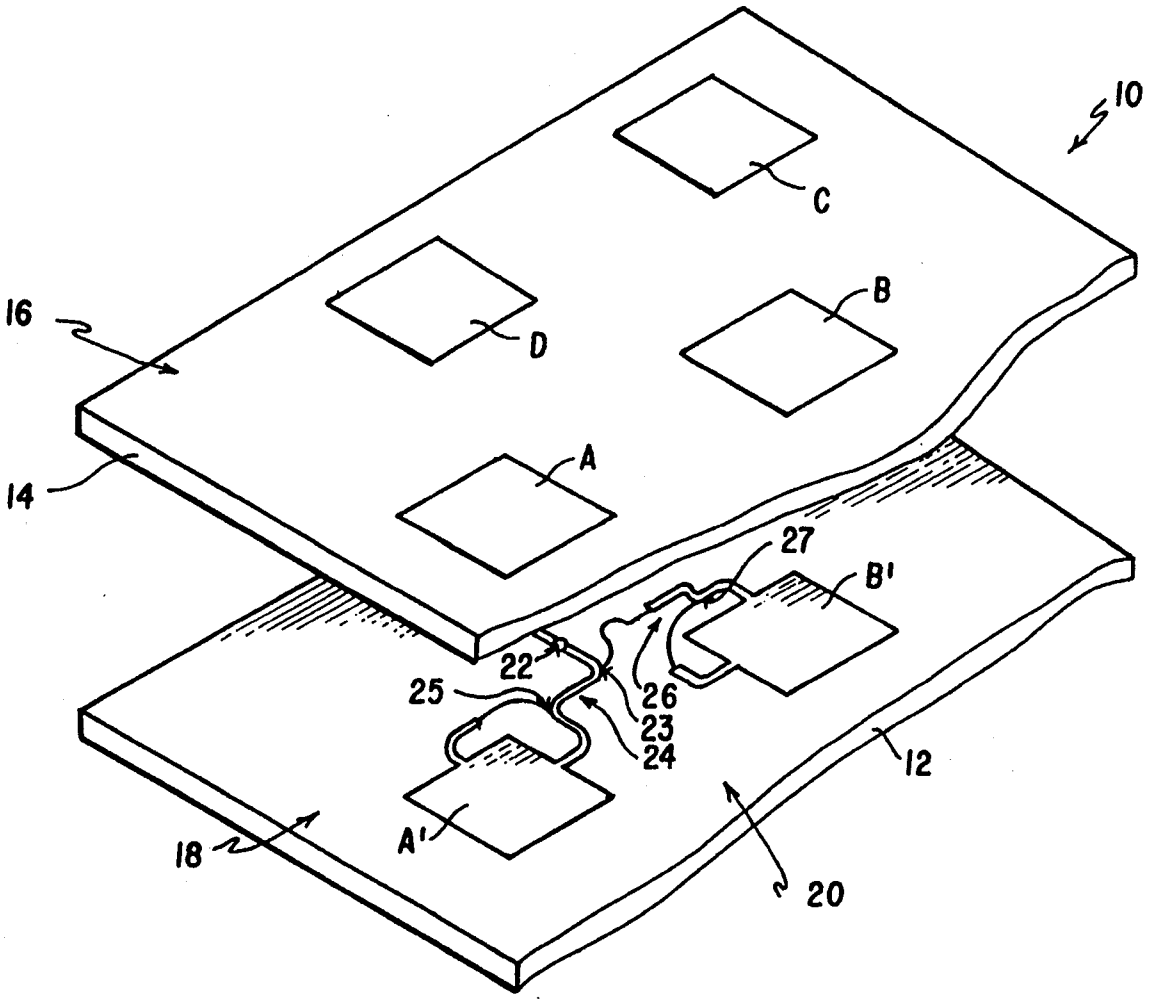
FIG. 1 illustrates an exploded, partially cutaway view of selected components of the present invention.

FIG. 1 illustrates an exploded, partially cutaway view of selected components of an antenna comprising one embodiment of the present invention, generally indicated as 10. The antenna 10 includes a first substrate 12 and a second substrate 14 which are positioned in substantially parallel relation. A subarray of parasitic microstrip patch antenna elements 16 is disposed on the top surface of second substrate 14. Individual antenna elements A, B, C and D are shown in FIG. 1. A subarray of corresponding driven microstrip patch coupling elements 18 is disposed on the top surface of first substrate 12. Individual coupling elements A′ and B′ are shown in FIG. 1 and form electromagnetically coupled patch pairs (EMCP pairs) AA′ and BB′ with antenna elements A and B of antenna subarray 16. Coupling elements C′ and D′ (not shown) form EMCP pairs CC′ and DD′ with corresponding antenna elements C and D. Coupling elements 18 and antenna elements 16 could be disposed on either the top or bottom surfaces of first and second substrates 12 and 14 so long as spacing therebetween is maintained to achieve the desired electromagnetic coupling and bandwidth.

Disposed on the same substrate surface as coupling elements 18 (i.e., top surface of substrate 12 in FIG. 1) are phase transmission line means, referred to collectively as an interconnect network 20, which couple coupling elements A'–D' to a signal transmission means (not shown) at a feed point 22. Interconnect network 20 divides a signal from the signal transmission means and distributes it among the coupling elements when antenna 10 is used for transmitting. It combines reception signals from the coupling elements and directs the resulting signal to the signal transmission means when antenna 10 is used for receiving. By way of example, phase transmission line means 24 couples feed point 22 and coupling element A', via junctions 23 and 25, and phase transmission line means 26 couples feed point 22 and coupling element B', via junctions 23 and 27

As will be appreciated, a microstrip patch element naturally radiates energy with linear polarization. It can be made to radiate circularly (or more accurately elliptically) polarized energy by exciting two orthogonal modes on the patch in phase quadrature (that is, with a 90° phase difference between the two modes). For example, the patches in coupling subarray 18 and antenna subarray 16 are substantially square in shape. As such, to obtain circular polarization, adjacent sides (being 90° apart) of each coupling element in coupling array 18 can be excited with signals which have a 90° phase difference. In interconnect network 20 shown in FIG. 1, such phase different is accomplished by proper selection of the lengths of the phase transmission line means coupled to adjacent sides of the coupling elements. For example, as to coupling element A', the length of phase transmission line means 24 from junction 25 to two adjacent sides of coupling element A' is offset to provide a 90° phase difference. Similarly, as to coupling element B', the length of phase transmission line means 26 from junction 27 to two adjacent sides of coupling element B' is offset to yield a 90° phase difference.

To achieve high quality circular polarization (i.e., polarization having a low axial ratio), a plurality of patches in an array can be excited in sequential rotation to reduce elliptical components. That is, if there are N elements in the array, the feed location of each patch is rotated or clocked by 360°/N from that of the previous patch in the sequence so that the feed locations within the array are substantially uniformly spaced around 360°. The signal fed to each element is similarly phase shifted by 360°/N from the previous patch in the sequence, relative to the signal at the first patch. The phase shift and rotation of the feed location of any coupling element in a coupling subarray, relative to the first element, is: $(P-1) * (360°/N)$, where P ($P>N$) is the element number in an array. Thus, radiation of one sense of circular polarization (such as right hand circular polarization) adds constructively while radiation of the opposite sense (such as left hand circular polarization) is substantially canceled. In the antenna 10 illustrated in FIG. 1, there are four EMCP pairs. The phase shift between adjacent pairs is therefore $360°/4=90°$. Similarly, the feed location on each coupling element in coupling subarray 18 is rotated 90° from that of the previous coupling element.

Unlike typical sequential rotation utilized by prior antenna arrays, sequential rotation of the present invention is provided by phase transmission line means without hybrids. In further contrast, EMCP pairs are employed with the phase transmission line means being disposed on a common substrate surface with the coupling patches. For example, the 90° phase shift between individual coupling element A' and individual coupling element B' in FIG. 1 is provided by selecting the relative lengths of phase transmission line means 24 and 26, and in particular, by establishing a greater length from junction 23 to 27 than from junction 23 to 25. As such, a signal received by coupling element B' is delayed by 90° relative to the signal received by coupling element A' due to the greater length through which it must travel to reach coupling element B'. It can be also seen in FIG. 1 that the feed locations on coupling element B' are rotated 90° counter-clockwise from the feed locations of coupling element A'. Similar phase shifts and rotations occur for coupling elements C' and D'.

The signal radiating from antenna 10 is essentially a combination of the radiation radiated from the four individual EMCP pairs. Due to the sequential rotation, the orientation of the somewhat elliptical radiation beams are rotated relative to each other such that the desired and undesired senses of circularly polarized radiation from each EMCP pairs tend to be strengthened and weakened, respectively. The combined result is a beam having a very low axial ratio in one circular sense and having substantially no radiation in the opposite sense.

Figure 2:
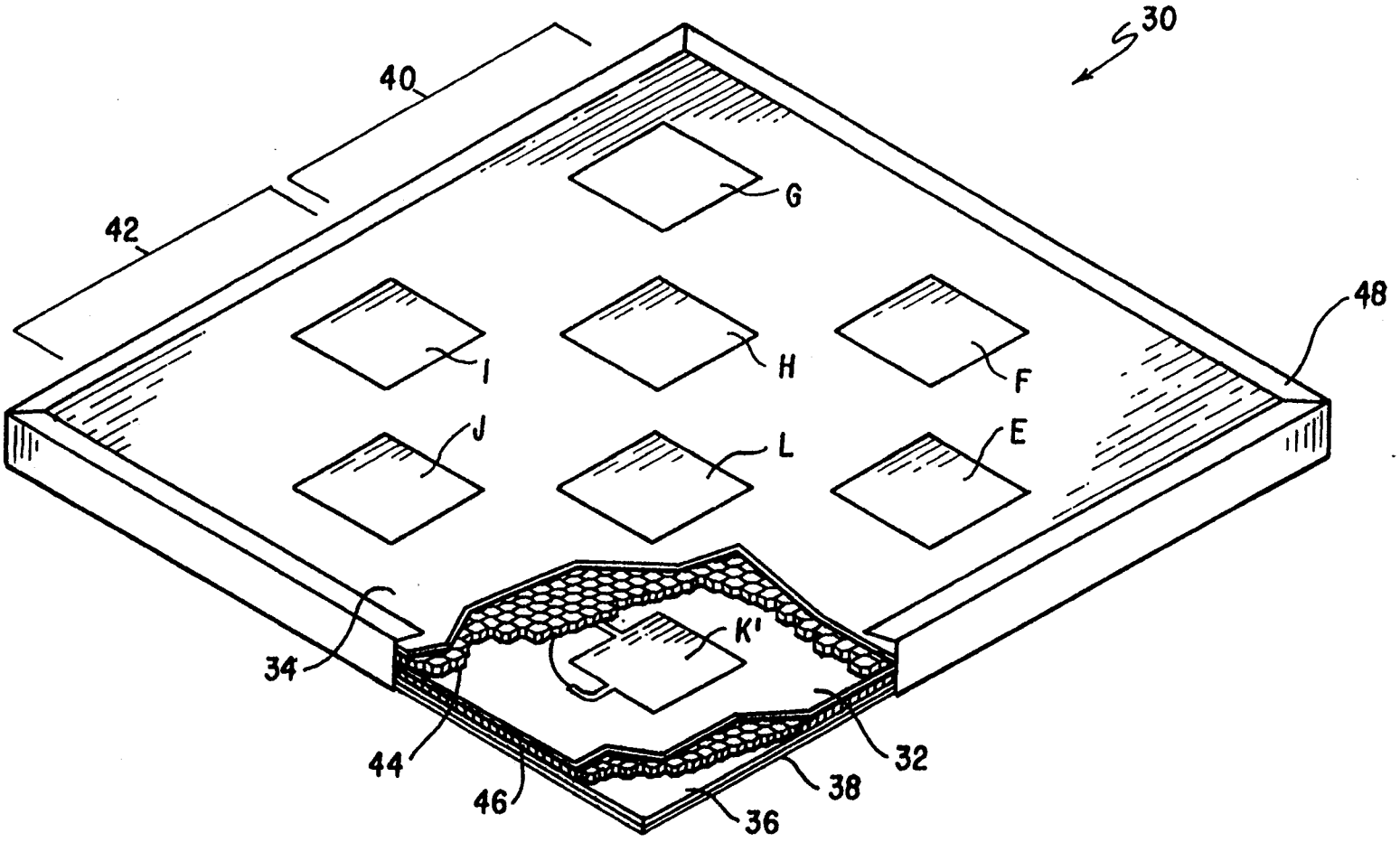
FIG. 2 illustrates a cutaway perspective view of an embodiment of the present invention.
Figure 3:
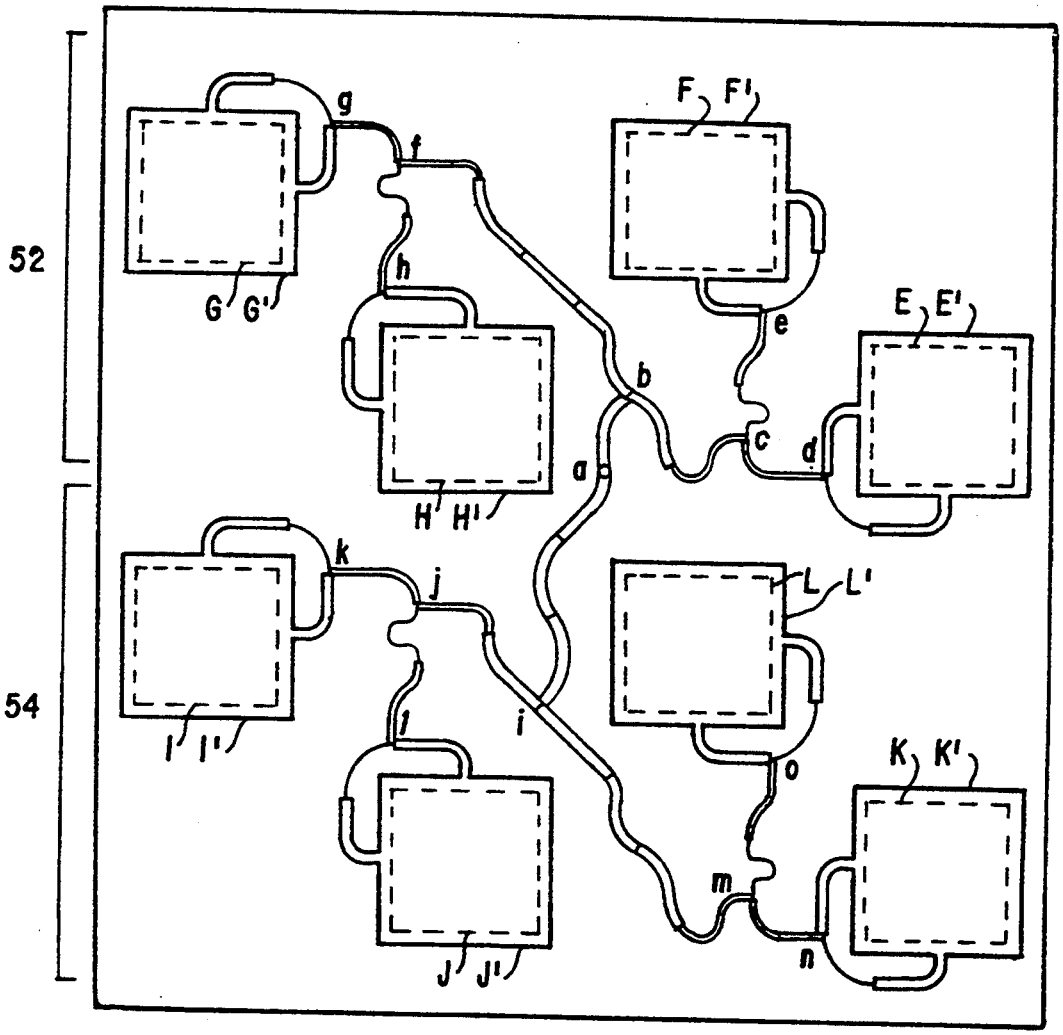
FIG. 3 illustrates the coupling elements (with 1 superimposed, corresponding parasitic antenna elements) and phase transmission line means of the embodiment illustrated in FIG. 2.

An embodiment of the antenna of the present invention is illustrated in FIGS. 2 and 3 and generally indicated as 30. A first substrate 32 and a second substrate 34 are positioned substantially parallel to each other and spaced a substantially uniform distance apart, defining a first resonant cavity. In the embodiment shown, a third substrate 36 is positioned below and substantially parallel to first substrate 32, defining a second resonant cavity. A ground plane 38 is disposed on the bottom surface of third substrate 36. Disposed on the top surface of second substrate 34 is a first subarray 40 of parasitic microstrip patch antenna elements and a second subarray 42 of parasitic microstrip patch antenna elements. As shown in FIG. 2, each subarray 40 and 42 has four microstrip patch antenna elements: first subarray 40 has antenna elements E, F, G and H; and second subarray 42 has antenna elements I, J, K and L (antenna element L is not shown in FIG. 2 due to the cutaway nature of the figure). Similarly, as shown in FIG. 3, two subarrays 52 and 54 of corresponding dual-fed coupling elements (E'–H' and I'–L') and corresponding interconnect networks are disposed on the top surface of first substrate 32. A first interconnect network of phase transmission line means (a-b-c-d to E', a-b-c-e to F', a-b-f-g to G', a-b-f-h to H') and a second interconnect network of phase transmission line means (a-i-j-k to I' a-i-j-l to J' a-i-m-n to K' a-i-m-o to L') connect the coupling elements in the two coupling subarrays to a feed signal transmission means (not shown) at feed point a. Such feed signal transmission means could be, for example, a coaxial cable.

A relatively rigid, lightweight and low dielectric constant spacing material is preferably positioned in the first resonant cavity between first and second substrates 32 and 34 and in the second resonant cavity between first and third substrates 32 and 36. In the embodiment shown in FIG. 2, honeycomb layers 44 and 46 fabricated from a phenolic resin can be advantageously employed. In another embodiment, illustrated in FIG. 5 and described in more detail hereinbelow, an expanded foam material can be positioned within one or both resonant cavities. The low dielectric constant of materials such as these, about 1 to about 1.5, and preferably about 1, increases the efficiency of the antenna, by, inter alia, reducing dielectric loading and associated losses, and also increases the bandwidth. Such materials also reduce weight and production costs. The entire assembly of antenna 30 in FIG. 2 can be held together by an edge closure 48 around the perimeter of antenna 30.

Analogous to the prior discussion pertaining to FIG. 1, first and a second antenna subarrays 40 and 42 and first and second coupling subarrays 52 and 54 of the embodiment shown in FIGS. 2 and 3 could be disposed on either the top or bottom surfaces of second and first substrates 34 and 32, provided that sufficient and uniform spacing is maintained therebetween to achieve the desired coupling and bandwidth. For example, the embodiment of FIGS. 2 and 3 could be modified such that first and second antenna subarrays 40 and 42 are disposed on the bottom surface of second substrate 34 and electromagnetically coupled with first and second coupling subarrays 52 and 54 through honeycomb spacing material 44, wherein second substrate 34 would be selected to permit passage of the desired radiation therethrough and contemporaneously serve as a protective radome.

Figure 5:
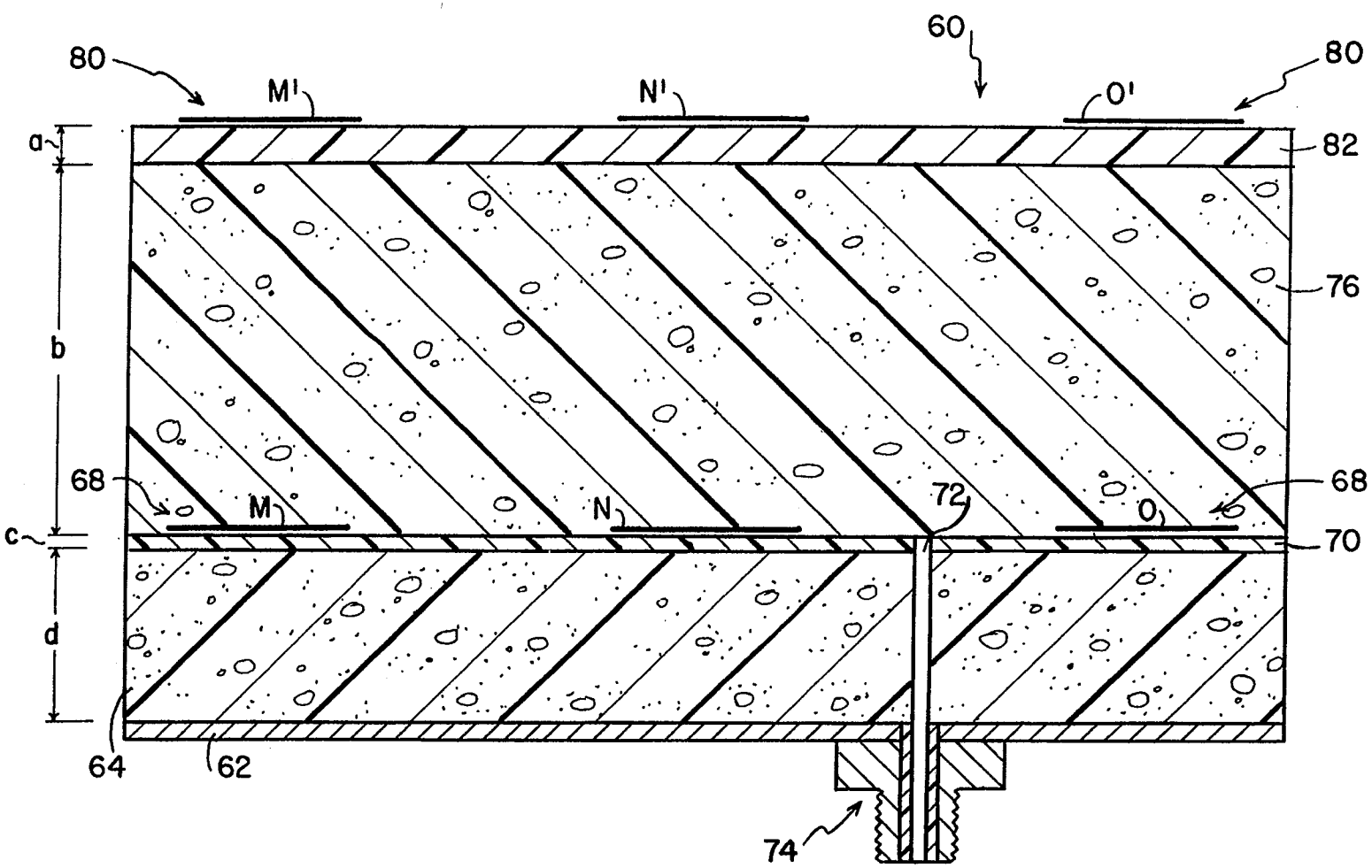
FIG. 5 illustrates a cross-sectional view of an embodiment of the present invention in which dielectric layers include expanded foam material with a low dielectric constant.

The phase transmission line means (a-b-c-d to E' a-b-c-e to F', a-b-f-g to G', a-b-f-h to H') of the first interconnect network and the phase transmission line means (a-i-j-k to I' a-i-j-l to J' a-i-m-n to K' a-i-m-o to L') of the second interconnect network are preferably microstrip transmission lines disposed on same substrate surface as first and second coupling subarrays 52 and 54 (i.e., the top surface of first substrate 32 in FIGS. 2 and 5). Such transmission lines could be so provided contemporaneous with coupling patches E'–L' by employing, for example, thin-film photo-etching or thickfilm printing techniques. For impedance and power matching between the signal transmission means and the coupling elements, the transmission lines forming the phase transmission line means can be of differing widths, as representatively shown in FIG. 3.

Phase shifting to produce an appropriate sequential rotation relationship among the coupling elements E'–L' of antenna 30 is accomplished with phase transmission line means, thereby saving space (e.g. space savings on first substrate 32 in FIGS. 2 and 3). The length of each phase transmission line means is preselected such that a signal is subjected to a predetermined time delay corresponding to a predetermined phase delay (or phase shift). That is, at a particular operating frequency, a phase transmission line means of a first length will cause a 90° phase shift. At the same frequency, a phase transmission line means of a greater second length will cause a 180° phase shift, and so on.

More particularly, four coupling elements in each of subarrays 52 and 54 are fed in sequential rotation with a 90° phase shift between adjacent elements. The phase shifting is accomplished with phase transmission line means only and uses no hybrids. In first subarray 52, coupling element E' is coupled to feed point a by a first phase transmission line means a-b-c-d to E'. Coupling element F' is coupled to feed point a by a second phase transmission line means a-b-c-e to f'. Coupling element G' is coupled to feed point a by a third phase transmission line means a-b-f-g to G'. Coupling element H' is coupled to feed point a by a fourth phase transmission line means a-b-f-h to H'.

In a second subarray 54, coupling element I' is coupled to feed point a by a fifth phase transmission line means a-i-j-k to I'. Coupling element J' is coupled to feed point a by a sixth phase transmission line means a-i-j-l to J'. Coupling element K' is coupled to feed point a by a seventh phase transmission line means a-i-m-n to K'. Coupling element L' is coupled to feed point a by an eighth phase transmission line means a-i-m-o to L'.

The lengths of first, second, third and fourth phase transmission line means a-b-c-d to E' a-b-c-e to F' a-b-f-g to G' and a-b-f-h to H' are selected wherein, at a predetermined operating frequency: a signal at coupling element E' is in a predetermined phase relationship with respect to the signal at feed point a; the signal at coupling element F' lags that at coupling element E' by 90°; the signal at coupling element G' lags that at coupling element E' by 180°; and, the signal at coupling element H' that at coupling element E' by 270°. Similarly, the lengths of fifth, sixth, seventh and eighth phase transmission line means a-i-j-k to I', a-i-j-l to J', a-i-m-n to K' and a-i-m-o to L' are selected wherein, at the predetermined operating frequency: the signal at coupling element I' is in a predetermined phase relationship with respect to the signal at feed point a; the signal at coupling element J' lags that at coupling element I' by 90°; the signal at coupling element K' lags that at coupling element I' by 180°; and, the signal at coupling element L' lags that at coupling element I' by 270°.

In the embodiment illustrated in FIG. 3, portions of two or more phase transmission line means are advantageously defined by a common length of line, thereby saving still more space on first substrate 32, reducing the complexity of interconnect networks, and reducing adverse coupling effects between phase transmission line means and coupling elements. Specifically, in first coupling subarray 52, a transmission line a-b is shared by first, second, third and fourth phase transmission line means a-b-c-d to E', a-b-c-e to F', a-b-f-g to G' and a-b-f-h to H'; a transmission line a-b-c is shared by first and second phase transmission line means a-b-c-d to E' and a-b-c-e to F'; and, a transmission line a-b-f is shared by third and fourth phase transmission line means a-b-f-g to G' and a-b-f-h to H'. In second coupling subarray 54, a transmission line a-i is shared by fifth, sixth, seventh and eighth phase transmission line means a-i-j-k to I', a-i-j-l to J' a-i-m-n to K' and a-i-m-o to L'; a transmission line a-i-j is shared by fifth and sixth phase transmission line means a-i-j-k to I' and a-i-k-l to J'; and, a transmission line a-i-m is shared by seventh and eighth phase transmission line means a-i-m-n to K' and a-i-m-o to L'.

To further enhance circularity, first coupling subarray 52 and second coupling subarray 54 of antenna 30 are themselves preferably disposed in a sequential rotation relationship: i.e., second coupling subarray 54 is rotated 180° from first coupling subarray 52. To accommodate the 180° physical rotation, the lengths of a ninth phase transmission line means a-b and a tenth phase transmission line means a-i are selected to enable second coupling subarray 54 to be fed with a signal which lags the signal fed to first coupling subarray 52 by 180°.

As previously noted, the coupling elements EMCP pairs EE'–LL' of antenna 30 are preferably fed in phase quadrature to achieve circular polarization. Since the coupling elements in the embodiment shown in FIGS. 2 and 3 are square, each coupling element is connected at adjacent sides to its associated phase transmission line means by two line components whose lengths are selected such that a 90° phase shift is provided between the two sides to provide circular polarization. For example, a first transmission line length connects the lower side of coupling element F' to junction e and a second transmission line length connects the right side of coupling element F' to junction e, the longer length of the second transmission line length effecting a 90° phase lag in the signal at the right side of coupling element F' relative to the signal at the lower side. The arrangement illustrated in FIG. 3 provides right hand circular polarized radiation patterns.

In operation, right hand circular polarized radiation from EMCP pair EE' and right hand circular polarized radiation from the EMCP pair FF' are in phase and add constructively, while left hand circular polarized radiation from the two pairs are 180° out of phase and substantially cancel. Similar additions and cancellations occur between EMCP pairs GG' and HH', between II' and JJ', and between KK' and LL'.

It can be appreciated that other patch geometries (such as circular, elliptical and rectangular patches) can be used and that other feed arrangements (such as a single corner feed) can be used to feed the coupling elements. Left hand circular polarization can also be obtained. Furthermore, a greater number of EMCP pairs can be used in each subarray with the phase difference between each being adjusted accordingly. That is, it is desirable that there be a substantially uniform phase difference of 360°/N, where N is the number of patch pairs; a patch pair P has a feed location orientation and a phase shift relative to the first patch pair of: (P−1),(360°/N).

As previously mentioned, an antenna array with sequentially rotated feed means and corresponding phase shifting provides good quality circular polarization in the present invention. Additionally, two or more such arrays may be used to produce a low axial ration over a wide bandwidth. The present invention may further employ an array of two or more such arrays which are sequentially rotated relative to each other with corresponding phase shifting to yield an even lower axial ratio. For example, within each of coupling subarrays 52 and 54 of the described embodiment, the rotation of each element is offset by appropriate phase shifting between elements to produce high-purity, right-hand circularly polarized radiation. Further, within antenna 30, the physical rotation of each EMCP subarray is offset by appropriate phase shifting between the two subarrays by 180°, thereby producing a normalizing effect which reduces reflective effects of impedance mismatches in the interconnect networks to produce right-hand circularly polarized radiation of particularly high purity.

It has been found that the total surface area of the antenna 30 can be relatively small, from about 2 to about 6 square wavelengths. Space restrictions, grating lobe considerations, desired gain and scan volume, mutual coupling and the complexity of the layout of the interconnect networks all influence final size determinations. If the size of the antenna 30 is increased beyond about 6 square wavelengths and the number of elements used remains the same, the larger element spacing results in reduced efficiency and increased grating lobes. While the number of the elements can be increased, the complexity of the interconnect networks would also be increased, thereby consuming additional space.

If the size of antenna 30 is smaller than about 2 square wavelengths and the number of elements is not decreased, there may not be enough space for both patches and interconnect networks and the increased density of elements tends to cause coupling between adjacent elements and between elements and the interconnect networks, thereby degrading the performance of antenna 30. If the number of elements is decreased to reduce adverse coupling, there may be too few elements to produce an acceptable beam or to satisfactorily receive a beam).

With the present invention, it has been found, therefore, that satisfactory performance with a substantially uniform radiation (or reception) pattern can be achieved with antenna 30 having an area of from about 2 to about 6 square wavelengths. A size of about $4\frac{1}{2}$ square wavelengths, with two subarrays 40 and 42 of four patch antenna elements each and two corresponding coupling subarrays 52 and 54 has been found to provide a satisfactory balance among the noted design factors (i.e., grating lobes, gain, scan volume, interconnect network complexity and mutual coupling). Additionally, the interconnect networks can be designed to substantially reduce coupling effects without significant crossovers in such an arrangement.

It has also been found that when the number of elements in antenna subarrays 40 and 42, and coupling subarrays 52 and 54 is a power of two, the interconnect network is less complicated (such as requiring only two-way junctions in order to obtain appropriate power splitting and phase shifting), making it easier to design and produce than if the number of elements is other than a power of two. When the total number of elements in antenna 30 (as opposed to each subarray thereof) is an even power of two (such as $2^4=16$), a "square lattice" arrangement (in which elements are located at each intersection of the rows and columns) can be used to obtain a square layout. When the total number of elements is an odd power of two (such as $2^3=8$), a "triangular lattice" arrangement (in which elements are located at alternating row and column intersections) will enable a square layout to be obtained, as illustrated in FIG. 3. It can be appreciated that, when two subarrays are employed, as they are in the embodiment illustrated in FIG. 3, the shape of the array will be a square if the number of elements in each subarray is an even power of two (such as $2^2=4$) so that the total number of elements in the antenna is an odd power of two such as $2^{3=8}$).

The embodiment of the present invention illustrated in FIGS. 2 and 3 is substantially square and has two subarrays 40 and 42, each of which has four elements arranged in a triangular lattice, and represents a satisfactory balance of performance, production and design factors.

Referring to FIG. 3, the patch pairs of the two subarrays 40 and 42 are arranged in a matrix having four horizontal rows (row 1 being the top row) and four vertical columns (column 1 being the left most column). In the triangular lattice shown, elements in each row are separated by a column and elements in each column are separated by a row. Thus, in row 1, EMCP pairs GG' and FF' are positioned in columns 1 and 3, respectively; in row 2, EMCP pairs HH' and EE' are positioned in columns 2 and 4, respectively; in row 3, EMCP II' and LL' are positioned in Columns 1 and 3, respectively, and in row 4, EMCP pairs JJ' and KK' are positioned in columns 2 and 4, respectively. This arrangement utilizes fewer EMCP pairs to provide substantially uniform radiation patterns with reduced grating lobes that would be possible with some other arrangements, such as two-by-four matrix. A further resulting benefit in a satellite application is that the useful scan volume of an antenna system having several arrays such as antenna 30 is about ±10°–13° which enables better access to low altitude (relative to the horizon) satellites than is possible with a scan volume of about ±9° (which is the required minimum for geosynchronous satellites).

Although other arrangements of the interconnect networks for coupling subarrays 52 and 54 are possible, the arrangement of the described embodiment is advantageous because it conserves space and does not require crossovers. In addition, more than two subarrays can be coupled in sequential rotation to provide even higher purity circular polarization. Alternatively, coupling subarrays 52 and 54 (and any additional subarrays in antenna 30) could be coupled to the signal transmission means in phase with each other using phase transmission line means having the same lengths.

Figure 4:
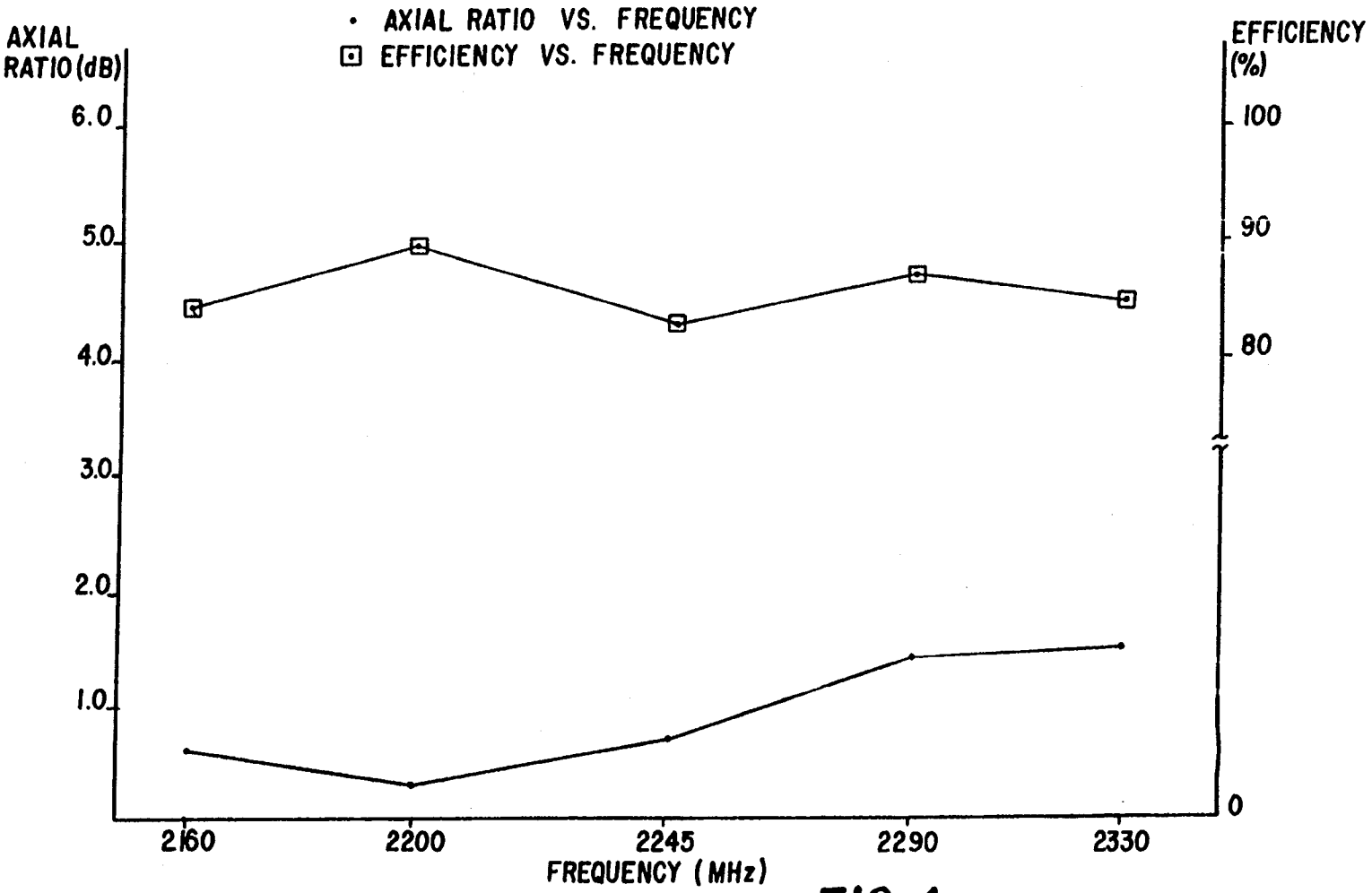
FIG. 4 graphically illustrates the axial ratio and efficiency of the embodiment illustrated in FIGS. 2 and 3 of the invention as functions of operating frequency.

FIG. 4 graphically illustrates the high quality of circular polarization of the described antenna 30 and its high efficiency. The axial ratio (in dB) is plotted against operating frequency in (MHz). The plot confirms that a very low axial ratio of 1.5 or less can be maintained over a bandwidth of about 7.6%. The efficiency (in percent) is also plotted against frequency. The plot confirms that high efficiency of the antenna 30 of at least about 83% is maintained over the same bandwidth. By comparison, a typical prior art antenna without sequential rotation, may have an efficiency of about 55%; and a typical prior art antenna employing conventional sequential rotation may have an efficiency of about 60%.

Antenna 30 can be packaged with additional similar antenna arrays for use on a satellite, for example, and with the use of phase shifters coupled to each array, a multiple scanning beam phased array antenna system can be provided. In one embodiment, twelve such antenna arrays are packaged to provide a complete antenna system. Each antenna array has two subarrays; each subarray has four EMCP pairs.

FIG. 5 illustrates a cross-sectional view of an embodiment of an antenna array 60 of the present invention in which dielectric layers in one or more resonant cavities include expanded foam material with a low dielectric constant. The antenna array 60 includes a lower electrically conductive ground surface 62 (which may be copper, lighter weight aluminum sheeting or other thin conductive material). An expanded foam dielectric 64 substantially fills the first set of resonant cavities located between conductive, driven, radiator patches elements M, N and O of driven radiator subarray 68 and the underlying ground surface 62. The driven radiator subarray 68 includes a relatively thin dielectric substrate 70 on which driven radiators M, N and O are disposed, along with interconnecting microstrip transmission lines feeding RF signals to/from a feed point 72 connected to a center conductor of a coaxial connector 74. An outer conductor of connector 74 is electrically connected to ground surface 62. The embodiment illustrated in FIG. 5 also preferably includes a second expanded foam layer 76 which substantially fills the second set of resonant cavities defined between the patches of driven radiator subarray 68 and parasitic radiator patches of parasitic subarray 80. Parasitic subarray 80 also includes a relatively thin dielectric substrate 82 with parasitic radiators M', N' and O' disposed thereon in an overlying relationship with driven patches M, N and O. As will be appreciated, the entire array of FIG. 5 may be encapsulated in a protective dielectric sheathing (not shown) selected so as to protect the structure from ambient environmental exposure without materially interfering with electromagnetic radiation passing to/from the antenna structure 60.

The expanded foam layers 64 and 76 can be made from low loss, high efficiency foam supplied by conventional suppliers (e.g., Rhoacell, a German manufacturer). Suitable such material is available with a loss tangent of approximately 0.004 and a real relative permittivity (dielectric constant) of approximately 1.08. As used in this application, such materials are considered to have a relative dielectric constant of approximately one. When such a material is used to fill the lower resonant cavities (i.e., between ground surface 62 and driven subarray 68), antenna bandwidth and efficiency increase and weight and production cost decrease. Such benefits are enhanced further when an expanded foam or like material is also used to fill the upper resonant cavities.

The solid dielectric substrates 70 and 82 employed for the driven and parasitic subarrays 68 and 80, respectively, can be of conventional epoxy fiberglass (e.g., of the type known as FR5) which has a substantially higher relative dielectric constant than that of foam layers 64 and 76. However, since only a relatively small portion of each resonant cavity is occupied by the solid dielectric material 70 and 82 (such as, for example, one-tenth or less), the effective overall dielectric constant for each resonant cavity is still approximately one (i.e., the dielectric constant of each resonant cavity is dominated by the much larger volume of expanded dielectric foam having a much lower relative dielectric constant).

An exemplary antenna was constructed of the embodiment illustrated in FIG. 5. The thicknesses a-d of the layers were selected to be, respectively, 0.48 mm, 6.35 mm, 0.12 mm and 3.0 mm and provided satisfactory performance of a specific design useful in a mobile satellite communications system (e.g., utilizing a frequency band from approximately 1530 megahertz to approximately 1660 megahertz). Other thicknesses can be selected based upon such factors as the desired application, bandwidth, operating frequency and size restrictions. The various layers 62, 64, 70, 76 and 82 can be cemented together using suitable adhesives. The dimensions given herein reflect use of a specific epoxy fiberglass bonding film (FM73 available from American Cyanamid). Use of other adhesives will, of course, cause slight changes in the dimensions of elements as will be apparent to those skilled in this art. For example, a roll-on contact adhesive (e.g., No. 1356-NF by 3M) or a spray-on contact adhesive (e.g., No. 30-NF by 3M) can be employed but will cause a slight increase in the exemplar dimensions for operation at the same frequency band.

Figure 6:
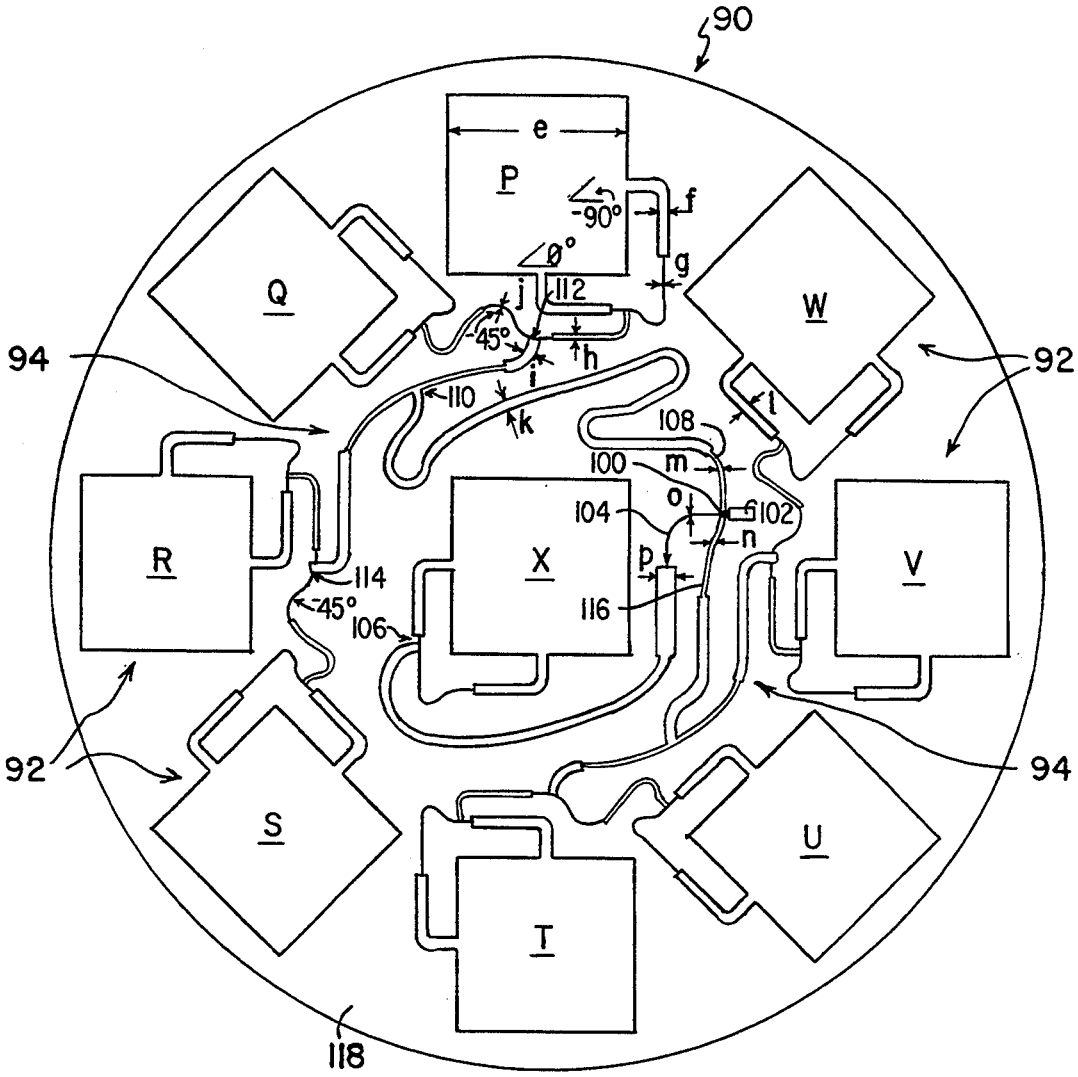
FIG. 6 illustrates a plan view of the driven coupling elements and associated feed network of another embodiment of the present invention.
Figure 7:
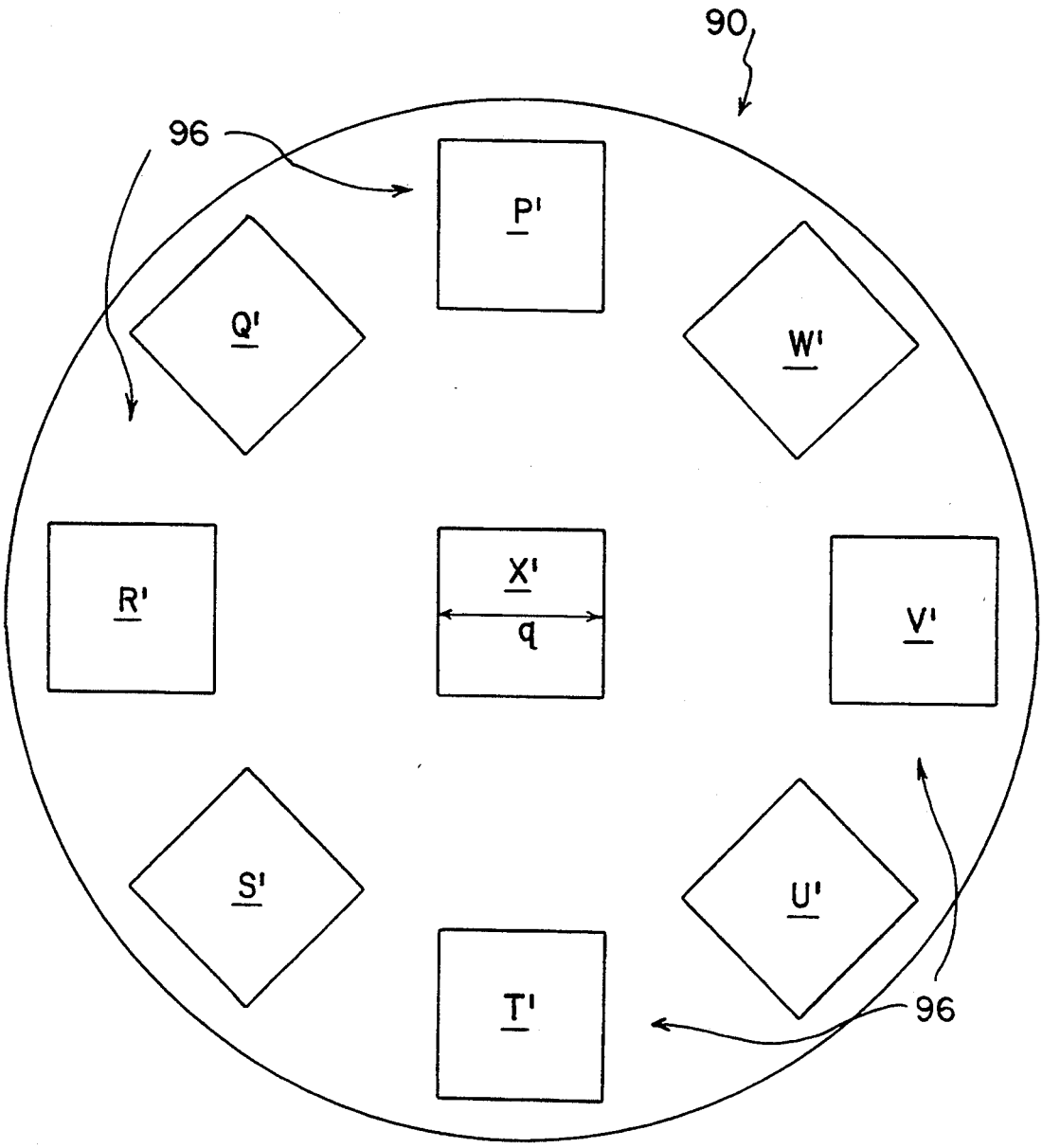
FIG. 7 illustrates a plan view of the parasitic elements of the embodiment of FIG. 6.

FIGS. 6 and 7 illustrate the arrangement of driven and parasitic patches and an associated feed network of another embodiment of the present invention. An antenna array 90 includes a driven microstrip radiator subarray 92 and its microstrip feed network 94 (illustrated in FIG. 6) and a parasitic microstrip radiator subarray 96 (illustrated in FIG. 7). All of the circularly arrayed driven microstrip radiators P through X are fed via microstrip transmission line from a common feed point 100. From inspection of the microstrip transmission line topography, it will be appreciated that each of the approximately square resonantly dimensioned radiators P-X is driven at orthogonal locations by signals that are substantially 90° out of phase (in phase quadrature) so as to transmit/receive right-hand circularly polarized radiation (left-hand circular polarization can also be accommodated). Since the elements are circularly arrayed, additional successive 45° phase shifts are included so as to mechanically clock the electromagnetic radiation passing to/from each of the elements into a common spatial orientation (insofar as the antenna far field is concerned). Such mechanical clocking is preferred since it substantially improves the VSWR and otherwise improves operation of the arrayed system.

Connected to feed point 100 is an impedance-matching stub 102 of microstrip transmission line. As will be appreciated by those in the art, the exact dimensions of this stub must be empirically determined for each particular antenna design so as to achieve the desired impedance matching (e.g., to a 50 ohm coaxial cable transmission line input/output port). Each driven radiator has a resonant dimension e. Dimensions f, g, h, i, j, k, 1, m, n, o and p are selected to provide desired phase shifting. The center driven radiator X is driven via a microstrip transmission line 104 which starts with two quarter-wavelength transformers. Continuing microstrip transmission line connects to a conventional power splitting and phase shifting microstrip circuit 106 which, in turn, feeds the left and lower sides of radiator X in phase quadrature. It will be appreciated by those in the art that, because of the topography depicted in FIG. 6, the RF signals fed to the lower side of radiator X will lag those fed to the left side of the same radiator by 90° thus producing right-hand circularly polarized operation for this radiator.

Driven microstrip radiators P-S are driven via a microstrip transmission line 108 (including a first quarter wavelength transformer followed by a serpentine line). Power splitting occurs at a junction 110 so as to feed radiator pairs P, Q and R,S, respectively. A quarter-wave transformer arrangement is again employed at each additional power splitting junction 112 and 114. It will be noted that there also is an extra 45° phase shift incorporated going from junctions 112 and 114 to radiators Q and S, respectively. It will be appreciated by those in the art that since each successive radiator P-S is spatially rotated by 45° with respect to its preceding neighbor radiator, this additional phase shifting is necessary to mechanically clock each radiator and thus assure that radiation electromagnetically coupled collectively to/from all radiators is spatially realigned to coincide in high purity circular polarized radiation.

As depicted in FIG. 6, the remaining four radiators T-W are also fed from the common feed point 100 via a microstrip line 116 which includes analogous power splitting and phase shifting microstrip circuits (including mechanical clocking as already described for radiators P-S).

Copper cladding can be photo-chemically etched on substrate 118 to form radiators P-X and the feed network 94. Alternatively, radiators P-X can be disposed on substrate 118 by screening a thick-film paste onto substrate 118 and then drying and firing the substrate/-metal assembly.

The parasitically coupled patch layer 96 is illustrated in FIG. 7, each radiator having a resonant dimension q. It will be noted that the parasitic patches P'–X' are coaxially disposed above their respective mating, preferably larger dimensioned, directly driven patches P-X and can be photo-etched or applied in a thick-film process.

Electrostatic discharge protection can be provided to any of the embodiments of the present invention without affecting antenna performance by grounding each microstrip patch antenna element with a Z-wire at the electrical center of the element. If additional stiffness is desirable, an additional layer(s) of spacing material and retaining substrate(s) could be added. For example, in relation to the embodiment of FIGS. 2 and 3, another layer of honeycomb material with an additional retaining substrate layer could be disposed below ground plane 38.

Although the present invention has been described in detail, it should be understood that various changes, substitutions and alterations can be made herein without departing from the spirit and scope of the invention as defined by the appended claims. For example, although the embodiments detailed herein employ electromagnetically coupled patch pairs, the present invention could also be constructed with arrays having directly fed antenna patches. In other embodiments, more than one parasitic element can be stacked above the lower, driven element to vary the bandwidth and/or other performance characteristics.

What is claimed is:

1. A multi-layer microstrip antenna comprising:

a plurality of stacks of resonantly-dimensioned radiator patches, each stack including a plurality of electromagnetically coupled radiator patches which are formed on corresponding dielectric substrates and stacked above one another with interleaved dielectric spacing material over an electrically conductive ground surface, said dielectric spacing material having a dielectric constant of approximately 1; and a dielectric layer having a relative dielectric constant of approximately 1 being disposed between said ground surface and the lowermost of said radiator patches, wherein the thickness of the dielectric layer is at least approximately ten times greater than the thickness of the adjacent, overlying dielectric substrate, and wherein the effective relative dielectric constant of the resonant cavities underlying all of said patches is approximately 1;

a microstrip RF feed network formed on a dielectric substrate which also carries said lowermost of said radiator patches;

wherein said patches are of approximately square resonant dimensions and wherein said microstrip RF feed network emanates from a coaxial feed pin through impedance matching and phase-shifting microstrip feedlines to plural feed points on said lowermost of said radiator patches to achieve approximately circular polarization of RF signals radiating to/from said patches.

2. A multi-layer microstrip antenna as in claim 1 having a plurality of such stacks of radiators arrayed equidistantly around a predetermined closed locus.

3. A multi-layer microstrip antenna as in claim 1 wherein the thickness of each layer of said dielectric spacing material is at least approximately ten times greater than the thickness of the respectively associated, overlying dielectric substrate.

4. A multi-layer microstrip antenna comprising an array of microstrip multi-layer radiator stacks, wherein each of said stacks includes:

a parasitically driven resonant radiator patch that is disposed on a first dielectric support layer and stacked above a directly driven microstrip radiator patch that is disposed on a second dielectric support layer, with first dielectric spacing material therebetween, said second dielectric support layer overlying a ground plane with a second dielectric spacing material therebetween, the thickness of the second dielectric spacing material being at least approximately ten times greater than the second dielectric support layer; and wherein the dielectrically loaded resonant cavity underlying said directly driven radiator patch has an effective relative dielectric constant which is approximately equal to one.

5. A multi-layer microstrip antenna as in claim 4, the thickness of said first dielectric spacing material being at least approximately ten times greater than the thickness of the first dielectric support layer, and wherein the effective relative dielectric constant of the resonant cavity underlying the parasitically driven radiator patch is approximately one.

* * * * *